US005099957A

United States Patent [19]

Eriksson

[11] Patent Number: 5,099,957

[45] Date of Patent: Mar. 31, 1992

[54] PROCEDURE AND APPARATUS FOR CONTROLLING A HYDRAULIC ELEVATOR DURING APPROACH TO A LANDING

[75] Inventor: Arvid Eriksson, Spanga, Sweden

[73] Assignee: Kone Elevator GmbH, Baar, Switzerland

[21] Appl. No.: 709,846

[22] Filed: Jun. 4, 1991

[30] Foreign Application Priority Data

Jun. 4, 1990 [FI] Finland ..... 902781

[51] Int. Cl.[5] ..... B66B 9/04

[52] U.S. Cl. ..... 187/111

[58] Field of Search ..... 187/111

[56] References Cited

U.S. PATENT DOCUMENTS

| | | | |
|---|---|---|---|
| Re. 33,171 | 2/1990 | Ogasawara et al. | 187/111 |
| 4,311,212 | 1/1982 | Simpson | 187/111 |
| 4,637,495 | 1/1987 | Blain | 187/111 |
| 4,715,478 | 12/1987 | Nakamura et al. | 187/111 |
| 4,991,693 | 2/1991 | Stern et al. | 187/111 |
| 5,040,639 | 8/1991 | Watanabe et al. | 187/111 |

*Primary Examiner*—A. D. Pellinen

*Assistant Examiner*—Lawrence Colbert

*Attorney, Agent, or Firm*—Sughrue, Mion, Zinn, Macpeak and Seas

[57] ABSTRACT

A procedure and apparatus for controlling a hydraulic elevator during approach to a landing are disclosed, in which the speed of the elevator and the temperature of the hydraulic fluid are measured prior to beginning deceleration of the elevator. The deceleration point is adjusted on the basis of the speed and temperature information. The elevator passes a deceleration flag while approaching a landing, which is used to measure the speed of the elevator, and to provide a reference point from which the location of the deceleration point is determined. At temperatures exceeding a given reference temperature, the normal deceleration point is shifted from the leading edge of the deceleration flag to its trailing edge, and the start of actual deceleration of the elevator is delayed in relation to the deceleration point (trailing edge of the deceleration flag) by an amount depending on the elevator speed and oil temperature. At temperatures below the given reference temperature, deceleration begins at the leading edge of the deceleration flag without delay.

12 Claims, 3 Drawing Sheets

PROCEDURE AND APPARATUS FOR CONTROLLING A HYDRAULIC ELEVATOR DURING APPROACH TO A LANDING

BACKGROUND OF THE INVENTION

The present invention relates to a procedure and an apparatus for controlling a hydraulic elevator during approach to a landing.

At present, hydraulic elevators with an on-off type hydraulic control system (open system) have the drawback that the length of the creeping distance during approach to a landing essentially varies with the load (oil pressure) and oil temperature (change in viscosity).

In certain operational circumstances, this variation may become excessively large and have a negative effect on the capacity of the elevator.

A long creep distance usually also involves an accelerating rise in the oil temperature and may necessitate extra cooling.

In practice, the variations in the creep distance mean that at a normal operating temperature this distance must be quite long to ensure that during low oil temperature operation (for example during the elevator's first drives in the morning), the elevator will not move past the landing when stopping. When the oil temperature is high, the creep distance usually becomes considerably longer, resulting in a reduced elevator capacity and an increased rate of rise of the oil temperature. The effect of the load means that, for example during up-travel at a given oil temperature, the creep distance for a car with full load is substantially longer than for an empty car.

Methods for correction of the deceleration point to achieve a shorter and more constant creep distance for varying loads and temperatures have been known for a long time. One way to accomplish this is as proposed in U.S. Pat. No. 4,534,452, in which a suitable delay at the next deceleration point is selected before start on the basis of load and temperature information. In this case, the effects upon what happens from the point of starting deceleration, due to changes in oil temperature or load variations (resulting from, for example, variations in guide friction) is not taken into account at all. Additionally, producing the load information requires a weighing device, which is often expensive if it is to give a sufficient accuracy.

U.S. Pat. No. 4,775,031 proposes a control method for hydraulic elevators whereby the speed and position of the elevator car is measured by means of a speed sensing tachometer, which requires space and is expensive.

SUMMARY OF THE INVENTION

Therefore an object of the present invention is to provide a method and apparatus for controlling an elevator during approach to a landing in which the creeping distance is essentially constant in spite of variations in the load and oil temperature.

According to one aspect of the invention, there is provided a procedure for controlling a hydraulic elevator during approach to a landing, which procedure comprises the steps of: measuring the speed of the elevator and the temperature of the hydraulic fluid; detecting a deceleration flag as the elevator passes the deceleration flag during its approach to the landing; and adjusting a deceleration point relative to the deceleration flag on the basis of the speed and temperature information, wherein, at oil temperatures below a predetermined reference temperature, deceleration of the elevator begins without delay at said deceleration point which is situated at the leading edge of said deceleration flag, and wherein, at temperatures exceeding said predetermined reference temperature, said deceleration point is shifted from the leading edge of said deceleration flag to its trailing edge, and the actual deceleration of the elevator is delayed in relation to said deceleration point by an amount which depends on the elevator speed and the oil temperature.

According to another aspect of the invention, there is provided an apparatus for controlling a hydraulic elevator during approach to a landing, said apparatus comprising: temperature measuring means for measuring the temperature of the hydraulic fluid; a control unit for adjusting a deceleration point and the point at which deceleration of the elevator begins in response to the measured speed and temperature information; at least one deceleration flag disposed adjacent to the path of the elevator, for providing a reference from which said control unit determines the location of said deceleration point; and a sensor disposed on the elevator car so as to detect the passage of said deceleration flag past said sensor during the approach of the elevator car to a landing, whereby, at oil temperatures below a predetermined reference temperature, said control unit causes the deceleration of the elevator to begin without delay at said deceleration point which is situated at the leading edge of the flag, and whereby, at temperatures exceeding said predetermined reference temperature, said control unit shifts the deceleration point from the leading edge of said deceleration flag to its trailing edge, and further delays the actual deceleration of the elevator in relation to said deceleration point by an amount which depends on the elevator speed and the oil temperature.

By employing the method and apparatus of the invention, the temperature of the oil and speed of the elevator car are determined immediately prior to the elevator car reaching the deceleration point, and this information is used to control the elevator during approach to a landing. Finally, load information is also indirectly obtained, from the temperature and speed information, without the requirement for an extra tachometer.

This invention enables the elevator's travel time to the landing to be shortened and rendered practically independent of the load and temperature variations.

BRIEF DESCRIPTION OF THE DRAWINGS

In the following, a preferred embodiment of the invention is described in detail with reference to the appended drawings, in which:

FIG. 8 presents the output voltage of an operational amplifier.

DESCRIPTION OF THE PREFERRED EMBODIMENTS

Figure 1:
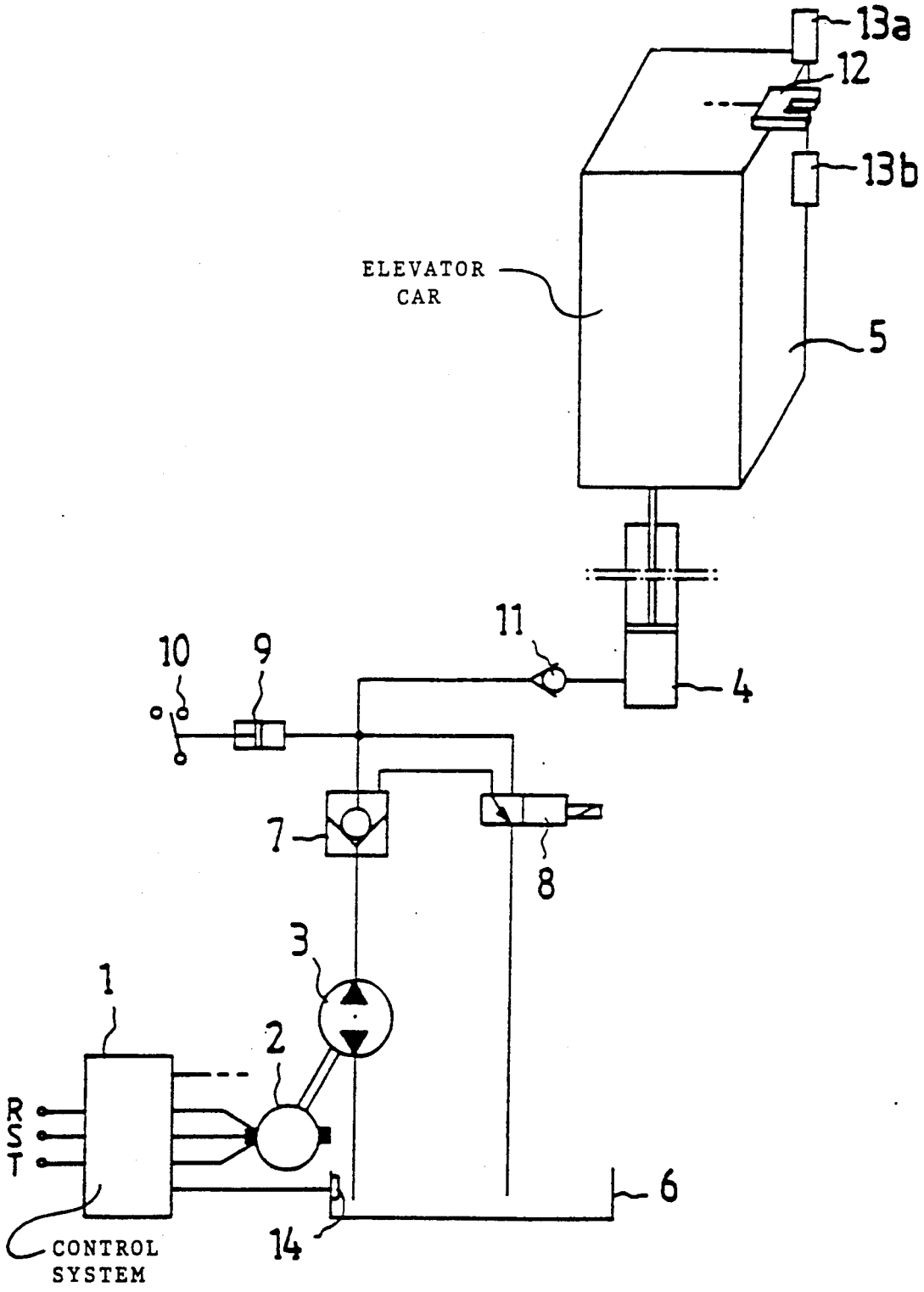
FIG. 1 shows a schematic illustration of a hydraulic elevator system.

Referring to FIG. 1, a hydraulic elevator employing the apparatus of the invention comprises: a control system 1, a three-phase squirrel-cage motor 2, a hydraulic pump 3 connected to the motor 2, a lifting cylinder 4 and an elevator car 5. In addition, the system further comprises an oil tank 6, an openable check valve 7, its actuator (magnetic valve) 8, a pressure limiting safety valve 9 and its switch 10, a safety valve 11 which senses the velocity of flow (in case of pipe damage), an impulse coupling 12 fitted to the top of the elevator car, and two metal vanes 13 attached to a wall of the elevator shaft. Immersed in the oil in the tank 6 is an NTC resistor 14. The impulse coupling 12 and the NTC resistor 14 are connected to the control system 1.

During upward motion of the elevator, the hydraulic pump 3 pumps hydraulic fluid via the check valve 7 into the lifting cylinder 4 at a rate determined by the electric motor 2. When the elevator is to move downwards, the check valve 7 is opened by means of the magnetic valve 8 so that the hydraulic fluid can flow from the lifting cylinder 4 back into the tank 6 via hydraulic pump 3.

According to the invention, control of the elevator during approach to a landing is based on two different information channels. A first channel provides information about the elevator speed before the deceleration point, obtained by measuring the time required for the impulse coupling 12 to pass the deceleration flag (two metal vanes 13*a* and 13*b*). The second channel provides information about the oil temperature, obtained by measuring the change of resistance in the NTC resistor 14.

In both cases, the information is processed and combined in an executive unit in the control system 1, which actively delays the deceleration point so that the distance for decelerated approach to the landing will vary only minimally with varying load and oil temperature.

Figure 2A:
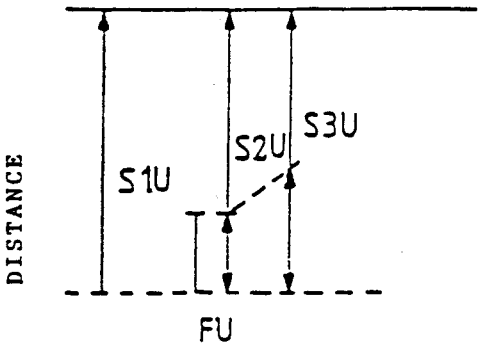
FIGS. 2*a* and 2*b* present deceleration distances for different oil temperatures.
Figure 2B:
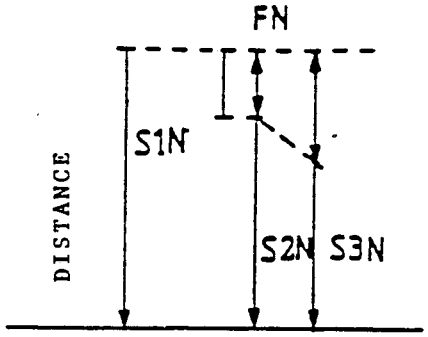

The basic principle of operation is as follows (ref. FIGS. 2*a* and 2*b*):

The normal deceleration point at the leading edge of the deceleration flag (note that the deceleration flag for upward travel is denoted as FU, while the deceleration flag for downward travel is denoted by FN) is shifted from the leading edge of the vanes 13*a* and 13*b* to the trailing edge when the oil temperature exceeds a given reference temperature, e.g. +25° C. The actual deceleration point is then delayed more or less (in relation to the trailing edge of the flag) depending on the load (speed) and temperature.

For example, at oil temperatures below +25° C., deceleration occurs from the leading edge of the flag without delay. S1U and S1N represent the deceleration distances up and down for oil temperatures below +25° C., and S2U, S2N, S3U and S3N the deceleration distances for oil temperatures above +25° C. for different loads and oil temperatures.

Figure 3:
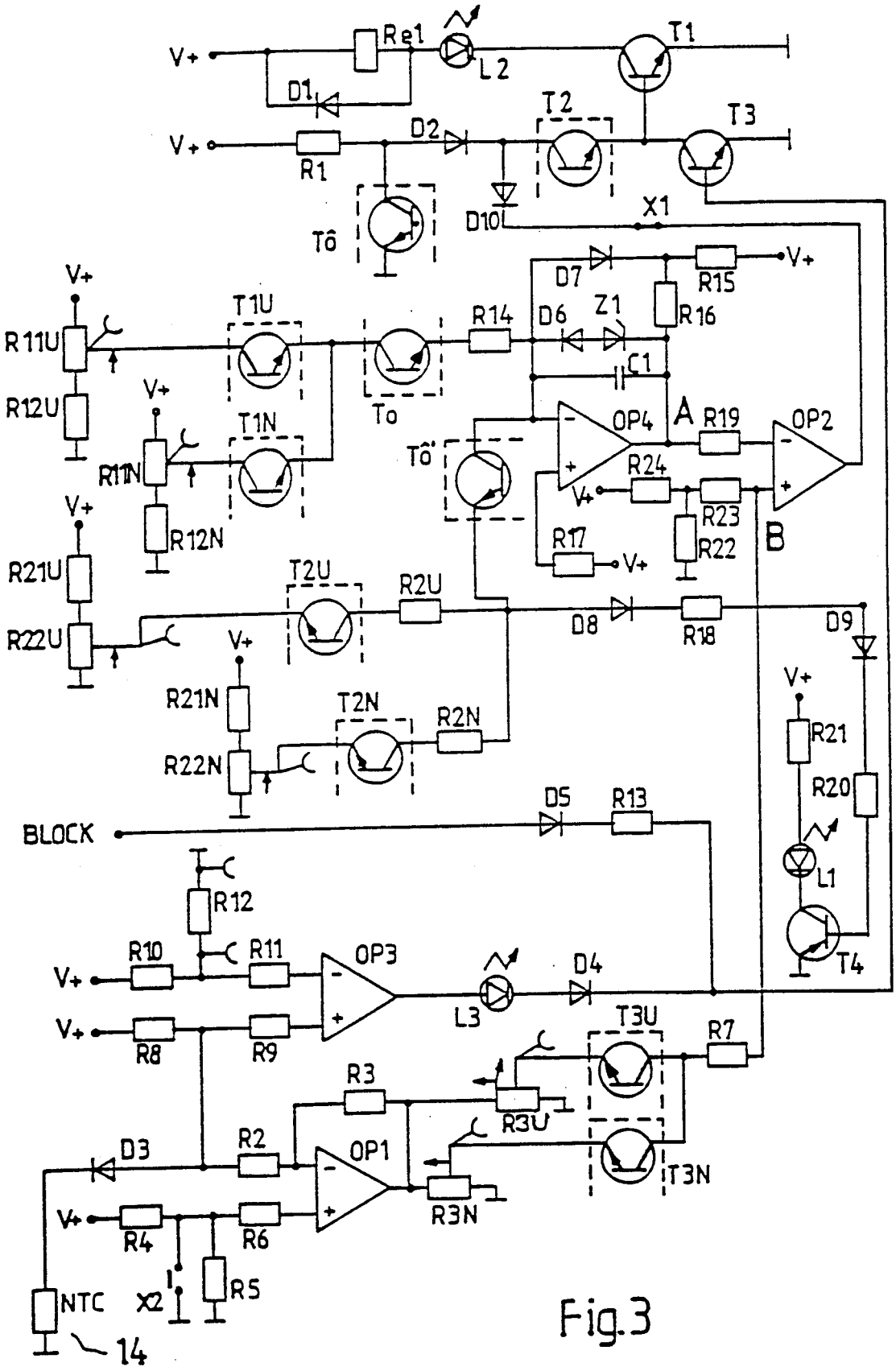
FIG. 3 shows a circuit diagram of a controlling device according to the invention.

FIG. 3 shows a simplified circuit diagram for implementing the control system according to the invention. Deceleration is controlled by means of a relay Re1, which is connected in series with a LED L2 and a transistor T1. The transistor T1 is controlled by a series-connection of a resistor R1, a diode D2, a transistor T2 (conducting up/down) and another transistor T3. Connected between resistor R1 and diode D2 is a transistor Tô, which conducts when the elevator is not on the deceleration flag (the oscillator sensor 12 is not active when the sensor is on the deceleration flag).

The signal from the NTC resistor 14 is passed via diode D3 and resistor R2 to an operational amplifier OP1, in which feedback occurs via resistor R3. One input (+) is connected to a positive voltage V+ via resistors R4–R6. This voltage can be blocked with a contact X2. The output of the operational amplifier OP1 is connected to two variable resistors R3U (up) and R3N (down), whose outputs are connected to corresponding transistors T3U (up) and T3N (down). Temperature compensation is adjusted by means of these variable resistors. Both transistors T3U and T3N are connected via resistor R7 to an operational amplifier OP2.

The signal from the NTC resistor 14 is also connected to an operational amplifier OP3 via a series connection of resistors R8 and diode R9. Their other terminals have the positive voltage V+. The other input of the operational amplifier OP3 is connected to the positive voltage V+ via resistors R10 and R11. Connected between these resistors is an other resistor R12. By changing this resistor, the reference temperature can be changed. The output of operational amplifier OP3 is connected to the control electrode of transistor T3 via LED L3 and diode D4. The delay can be prevented by means of the signal BLOCK, which is connected to transistor T3 via diode D5 and resistor R13.

For up-travel, the 0-setting of the delay at the reference temperature is effected by means of resistors R11U (variable) and R12U, connected in series between the V+ voltage and zero, the transistor T1U (up), connected to the output of the variable resistor, and for down-travel by means of resistors R11N and R12N and transistor T1N (down). Both transistors are connected to transistor To, which conducts when the elevator is on the deceleration flag (the oscillator sensor 12 is active when the sensor is on the deceleration flag), and via resistor R14 to an integrating circuit consisting of an operational amplifier OP4, a capacitor C1, diodes D6, D7 and Z1 (Zener) and resistors R15–R17.

Load compensation is adjusted by means of a corresponding circuit, consisting of resistors R21U and R22U (variable) and transistor T2U for up-travel, and resistors R21N and R22N, transistor T2N and resistors R2U and R2N, which are connected to the integrating circuit via transistors Tô', which conducts when the elevator is not on the deceleration flag (the oscillator sensor 12 is not active when the sensor is on the deceleration flag). The output of the integrating circuit is connected via a resistor R19 to the operational amplifier OP2.

Resistors R2U and R2N are also connected via diodes D8 and D9 and resistors R18 and R20 to the control electrode of a transistor T4, which is connected in series with a LED L1 and a resistor R21. The output of operational amplifier OP2 is connected via contact X1 and the diode D10 to a point between diode D2 and transistor T2. The positive voltage V+ is connected via resistors R22–R24 to this operational amplifier.

At temperatures exceeding the reference temperature, the signal from the NTC resistor 14 is passed via operational amplifier OP1 and transistor T3U or T3N to operational amplifier OP2. The load compensation and 0-setting signal is also passed to OP2 via the integrating circuit. The deceleration point is shifted in accordance with the comparison between these two signals by applying the output signal to the control electrode of transistor T1 so that relay Re1 is activated. At temperatures below the reference temperature, the output of operational amplifier OP3 is high and the signal is passed via LED L3 and diode D4 to the control electrode of transistor T3, which starts to conduct. Transistor T1 is turned off (non-conducting) and relay Re1 is not activated at the deceleration flag and after it. In FIGS. 2a and 2b, the relay Re1 is not activated while the elevator is passing through the deceleration distances S1U and S1N, operational amplifier OP3 is high, transistor T3 conducts and transistor T1 is off. During deceleration through distances S2U, S3U, S2N and S3N, the relay Re1 is activated (bolder arrow).

Figure 4A:
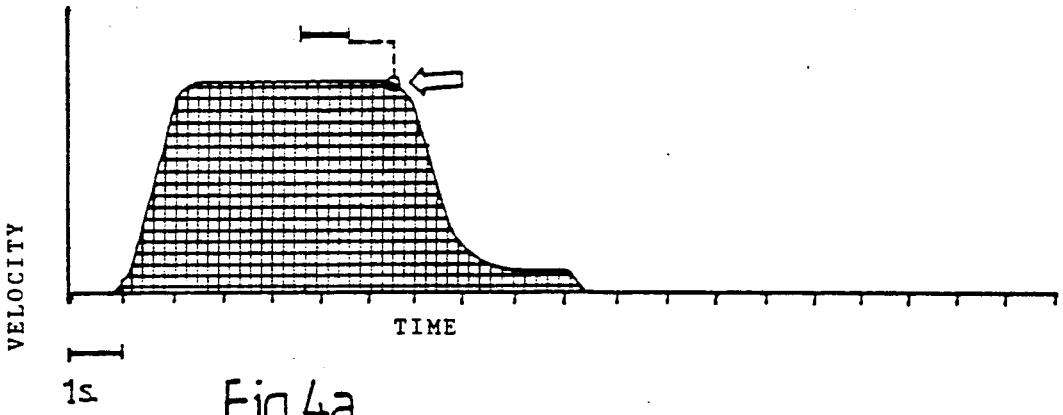
FIGS. 4*a* and 4*b* present deceleration and creep distances for elevators with and without the control system of the invention.
Figure 4B:
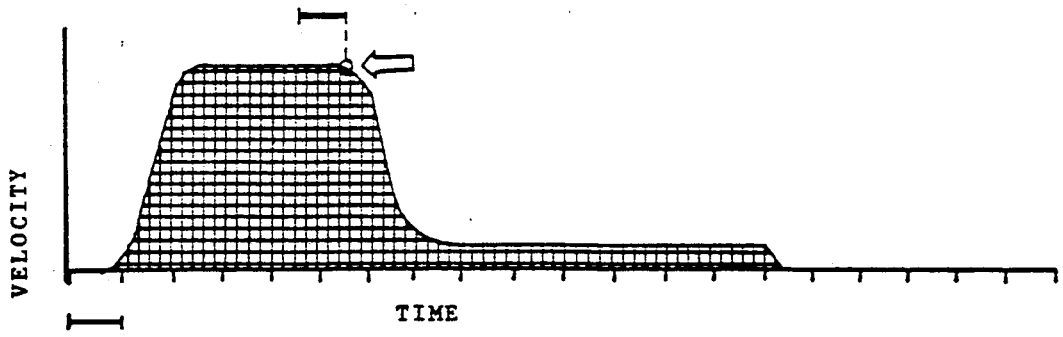
Figure 5:
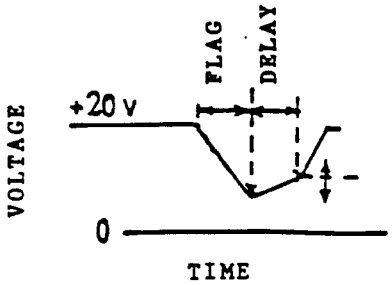

FIGS. 4a and 4b illustrate the deceleration and creep distance in the case of an elevator with the control system of the invention (FIG. 4a) and an elevator without it. The arrow indicates the deceleration point. The load is assumed to be 0 and the oil temperature +40° C. As shown by the figures, the system of the invention achieves a significant reduction in the creep distance (speed 0.05 m/s for 1 second in FIG. 4a, and 6 seconds in FIG. 4b). FIG. 5 represents the voltage A at the flag in FIG. 3 and the delay. The delay ends at a voltage determined at point B.

It will be apparent to a person skilled in the art that the invention is not restricted to the example described above, but that it may instead be varied within the scope of the following claims.

I claim:

1. A procedure for controlling a hydraulic elevator during approach to a landing, which procedure comprises the steps of:

measuring the speed of the elevator and the temperature of the hydraulic fluid;

detecting a deceleration flag as the elevator passes the deceleration flag during its approach to the landing; and adjusting a deceleration point relative to the deceleration flag on the basis of the speed and temperature information, wherein, at oil temperatures below a predetermined reference temperature, deceleration of the elevator begins without delay at said deceleration point which is situated at the leading edge of said deceleration flag, and wherein, at temperatures exceeding said predetermined reference temperature, said deceleration point is shifted from the leading edge of said deceleration flag to its trailing edge, and the actual deceleration of the elevator is delayed in relation to said deceleration point by an amount which depends on the elevator speed and the oil temperature.

2. A procedure according to claim 1, wherein the speed of the elevator and the temperature of the hydraulic fluid are measured essentially just before the elevator reaches said deceleration point.

3. A procedure according to claim 1, wherein the elevator speed is measured by measuring the time required for a sensor mounted on the elevator car to pass said deceleration flag.

4. A procedure according to claim 2, wherein the elevator speed is measured by measuring the time required for a sensor mounted on the elevator car to pass said deceleration flag.

5. An apparatus for controlling a hydraulic elevator during approach to a landing, said apparatus comprising:

speed measuring means for measuring the speed of the elevator;

temperature measuring means for measuring the temperature of the hydraulic fluid;

a control unit for adjusting a deceleration reference point and the actual point at which deceleration of the elevator begins in response to the measured speed and temperature information;

at least one deceleration flag disposed adjacent to the path of the elevator, for providing a reference from which said control unit determines the location of said deceleration point; and a sensor disposed on the elevator car so as to detect the passage of said deceleration flag past said sensor during the approach of the elevator car to a landing, whereby, at oil temperatures below a predetermined reference temperature, said control unit causes the deceleration of the elevator to begin without delay at said deceleration point which is situated at the leading edge of the flag, and whereby, at temperatures exceeding said predetermined reference temperature, said control unit shifts the deceleration point from the leading edge of said deceleration flag to its trailing edge, and further delays the actual deceleration of the elevator in relation to said deceleration point by an amount which depends on the elevator speed and the oil temperature.

6. An apparatus according to claim 5, wherein said control unit measures the elevator speed by measuring the time required for a sensor attached to the elevator car to pass said deceleration flag.

7. An apparatus according to claims 5, wherein said control unit further comprises:

a relay (Re1) or equivalent for the control of deceleration;

a semiconductor device (T1) connected in series with said relay (Re1), to allow adjustment of temperature compensation;

an operational amplifier circuit (OP1) supplied by said temperature measuring means, for controlling said semiconductor device (T1);

a first circuit for load compensation;

a second circuit for 0-setting of said delay of deceleration; and an integrating operational amplifier (OP4) supplied by said first and second circuits, wherein the outputs of said operational amplifier circuit (OP1) and said integrating amplifier (OP4) are connected to a comparator circuit (OP2), which controls said semiconductor device (T1) at temperatures exceeding the given reference temperature.

8. An apparatus according to claim 7, wherein said operational amplifier circuit (OP1), said first circuit for adjustment of load compensation, and said second circuit for 0-setting of said delay of deceleration, comprise separate elements for up-travel and down-travel of the elevator.

9. An apparatus according to claim 5, wherein said control unit further comprises means for controlling deceleration of said elevator at temperatures below said predetermined reference temperature.

10. An apparatus according to claim 6, wherein said control unit further comprises means for controlling deceleration of said elevator at temperatures below said predetermined reference temperature.

11. An apparatus according to claim 7, wherein said control unit further comprises means for controlling deceleration of said elevator at temperatures below said predetermined reference temperature.

12. An apparatus according to claim 8, wherein said control unit further comprises means for controlling deceleration of said elevator at temperatures below said predetermined reference temperature.

* * * * *